US008511285B2

(12) United States Patent
Konohara et al.

(10) Patent No.: US 8,511,285 B2
(45) Date of Patent: Aug. 20, 2013

(54) EVAPORATED FUEL TREATMENT APPARATUS FOR INTERNAL COMBUSTION ENGINE

(75) Inventors: Hirokazu Konohara, Inazawa (JP); Fumihito Nakatani, Tokai (JP); Tatsuya Furuhashi, Nagoya (JP)

(73) Assignee: Aisan Kogyo Kabushiki Kaisha, Obu-Shi (JP)

( * ) Notice: Subject to any disclaimer, the term of this patent is extended or adjusted under 35 U.S.C. 154(b) by 319 days.

(21) Appl. No.: 12/945,201

(22) Filed: Nov. 12, 2010

(65) Prior Publication Data

US 2011/0146631 A1 Jun. 23, 2011

(30) Foreign Application Priority Data

Dec. 23, 2009 (JP) ..... 2009-291553

(51) Int. Cl.
*F02M 25/08* (2006.01)

(52) U.S. Cl.
USPC ..... 123/520; 123/518

(58) Field of Classification Search
USPC ..... 123/516, 518, 519, 520; 417/151, 417/152
See application file for complete search history.

(56) References Cited

U.S. PATENT DOCUMENTS 5,020,503 A * 6/1991 Kanasashi ..... 123/520
5,383,438 A * 1/1995 Blumenstock ..... 123/520
5,918,580 A * 7/1999 Hennrich et al. ..... 123/520
6,453,886 B2 * 9/2002 Takano et al. ..... 123/520
6,880,534 B2 * 4/2005 Yoshiki et al. ..... 123/520
2007/0295303 A1 12/2007 Hirooka

FOREIGN PATENT DOCUMENTS

JP A-7-238872 9/1995
JP A-8-051795 2/1996
JP A-9-264199 10/1997
JP A-10-103082 4/1998
JP A-2007-303346 11/2007
JP A-2007-327461 12/2007

OTHER PUBLICATIONS

Mar. 19, 2013 Office Action issued in Japanese Patent Application No. 2009-291553 (with English Translation).

* cited by examiner

*Primary Examiner* — Stephen K Cronin
*Assistant Examiner* — Elizabeth Hadley
(74) *Attorney, Agent, or Firm* — Oliff & Berridge, PLC

(57) ABSTRACT

An evaporated fuel treatment apparatus collects vapor, generated in a fuel tank, in a canister. A bypass passage is provided for an intake passage. An ejector is placed in the bypass passage to generate a negative pressure by air flowing in the bypass passage. When the negative pressure occurs in the ejector, the vapor collected in the canister is drawn from the canister to the ejector through the purge passage and then purged from the bypass passage to the intake passage. An open/close valve placed in the ejector is configured to allow or block the flow of air from the intake passage to the bypass passage according to a pressure difference between the pressure in an upstream portion and the pressure in a downstream portion of the bypass passage during engine operation.

7 Claims, 9 Drawing Sheets

EVAPORATED FUEL TREATMENT APPARATUS FOR INTERNAL COMBUSTION ENGINE

CROSS-REFERENCE TO RELATED APPLICATIONS

This application is based upon and claims the benefit of priority from the prior Japanese Patent Application No. 2009-291553 filed on Dec. 23, 2009, the entire contents of which are incorporated herein by reference.

TECHNICAL FIELD

The present invention relates to an evaporated fuel treatment apparatus for an internal combustion engine to treat evaporated fuel by collecting or trapping evaporated fuel, generated in a fuel tank, in a canister and purging the collected evaporated fuel to an intake passage of the internal combustion engine.

BACKGROUND ART

Heretofore, one of such techniques has been known as an evaporated fuel treatment apparatus disclosed in for example JP 2007-303346A. This apparatus is designed for use in engines of a hybrid vehicle (HV) and a vehicle equipped with a continuously variable transmission (CVT), which are recently actively developed.

In general, an evaporated fuel treatment apparatus is configured to purge evaporated fuel collected or trapped in a canister by use of a negative pressure generated in an intake passage so that the evaporated fuel is fed into the intake passage. Accordingly, this apparatus has a problem that could not sufficiently purge the evaporated fuel to the intake passage when the negative pressure in the intake passage decreases. The engines of the HV vehicle and the CVT-equipped vehicle are usually subjected to air-fuel ratio control that more often utilizes fuel-saving, low-rotation and high-load regions. Accordingly a throttle valve is frequently brought into a widely open state over all the operations, resulting in that a negative pressure may be less apt to occur in the intake passage. In particular, during normal operation of the engine, that is, during steady operation or accelerated operation, the negative pressure is less likely to occur in the intake passage. In the engines of the HV vehicle and the CVT-equipped vehicle, it is hard to make effective use of the evaporated fuel treatment apparatus by utilization of the negative pressure in the intake passage.

Accordingly, the evaporated fuel treatment apparatus disclosed in JP 2007-303346A includes an ejector in the intake passage to generate a larger negative pressure than the negative pressure in the intake passage. The ejector is placed in a bypass passage provided for the intake passage. To purge the evaporated fuel collected in the canister to the intake passage, a second end of a first path whose first end is connected to the canister is connected to the ejector. A first end of a second path is connected to some midpoint of the first path through a three-way valve. A second end of the second path is connected to the intake passage. The three-way valve is switched according to an operating state of the engine to purge the evaporated fuel collected in the canister from the first path to the intake passage via the three-way valve and the second path or purge more evaporated fuel from the first path to the intake passage via the ejector.

SUMMARY OF INVENTION

Technical Problem

However, in the evaporated fuel treatment apparatus disclosed in JP 2007-303346A, the second path is placed to purge more evaporated fuel to the intake passage by making the ejector function or to purge the evaporated fuel to the intake passage without making the ejector function. Accordingly, the apparatus structure is more complicated by placement of the second path to selectively use the ejector.

The present invention has been made to solve the above problems and has a purpose to provide an evaporated fuel treatment apparatus capable of purging evaporated fuel collected in a canister irrespective of an operating state of an internal combustion engine and also providing a simple configuration to selectively use an ejector.

Solution to Problem

To achieve the above purpose, one aspect of the invention provides an evaporated fuel treatment apparatus to be provided in an internal combustion engine including a throttle valve in an intake passage, the evaporated fuel treatment apparatus being arranged to treat evaporated fuel generated in a fuel tank by collecting the evaporated fuel in a canister and purging the collected evaporated fuel to the intake passage through a purge passage, wherein the evaporated fuel treatment apparatus comprises: a bypass passage provided for the intake passage; an ejector placed in the bypass passage and arranged to generate a negative pressure by air flowing from the intake passage to the bypass passage; the purge passage being connected to the ejector so that the negative pressure generated in the ejector draws the collected evaporated fuel from the canister to the ejector through the purge passage, the evaporated fuel being to be purged to the intake passage through the bypass passage; and an air-flow adjusting device for allowing or blocking flow of air from the intake passage into the bypass passage according to a pressure difference between pressure in an upstream portion and pressure in a downstream portion of the bypass passage during operation of the internal combustion engine.

Advantageous Effects of Invention

According to the present invention, is it possible to simplify a configuration capable of purging evaporated fuel collected in a canister to an intake passage irrespective of an operating state of an internal combustion engine and also selectively use an ejector.

DESCRIPTION OF EMBODIMENTS

First Embodiment

A detailed description of a first preferred embodiment of an evaporated fuel treatment apparatus for an internal combustion engine according to the present invention will now be given referring to the accompanying drawings. This embodiment is explained on the assumption that the internal combustion engine is an engine of an HV vehicle or a CVT-equipped vehicle.

Figure 1:
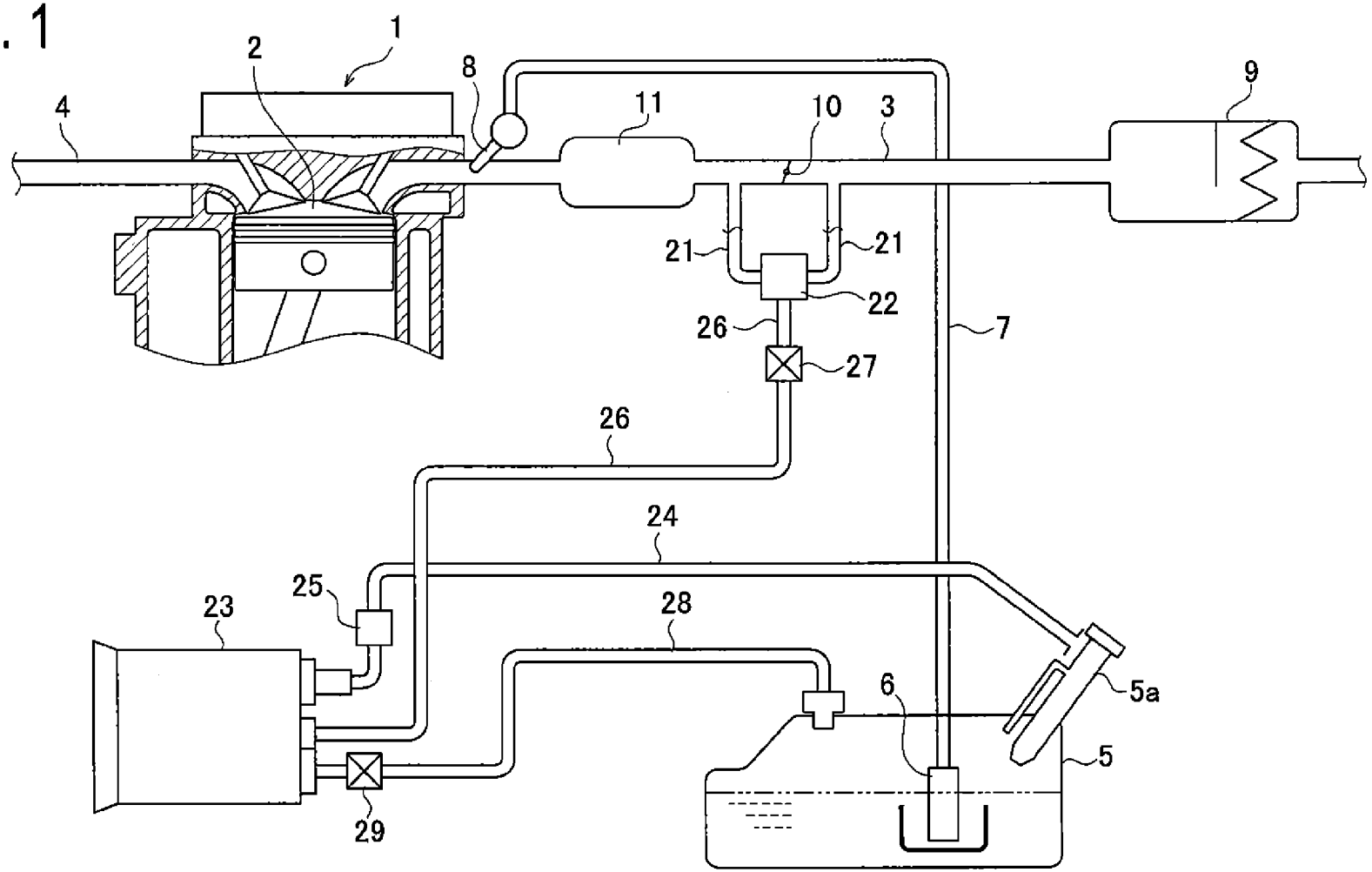
FIG. 1 is a schematic diagram showing an engine system including an evaporated fuel treatment apparatus in a first embodiment.

FIG. 1 is a schematic diagram showing an engine system including an evaporated fuel treatment apparatus in this embodiment. An engine 1 includes an intake passage 3 for taking outside air into a combustion chamber 2, and an exhaust passage 4 for discharging exhaust gas out of the combustion chamber 2. The combustion chamber 2 is supplied with fuel from a fuel tank 5. Specifically, the fuel in the fuel tank 5 is discharged to a fuel passage 7 by a fuel pump 6 built-in the tank 5 and pressure-fed to an injector 8 provided in the intake passage 3. The pressure-fed fuel is injected by the injector 8, sucked into the combustion chamber 2, and then burnt therein.

In the intake passage 3, an air cleaner 9, a throttle valve 10, and a surge tank 11 are arranged from its entrance side to the engine 1 side. The throttle valve 10 is opened and closed to adjust the flow rate of intake air in the intake passage 3. The opening and closing of the throttle valve 10 are interlocked with the operation of an accelerator pedal (not shown) by a driver. The surge tank 11 is to smooth pulsation of intake air in the intake passage 3.

Figure 2:
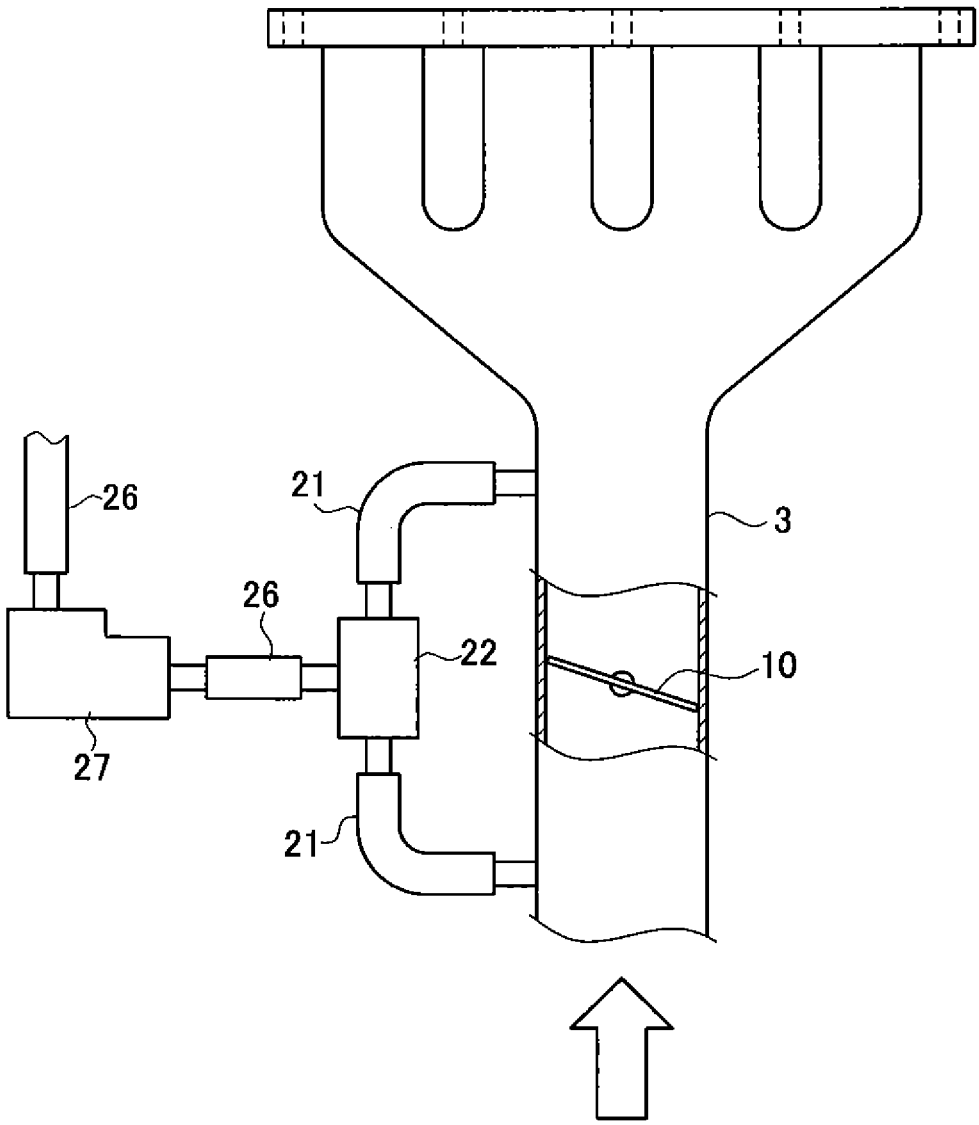
FIG. 2 is a schematic diagram showing configurations of an intake passage, a bypass passage, and others in the first embodiment.

In this embodiment, the intake passage 3 is provided with a bypass passage 21. The bypass passage 21 is placed between the air cleaner 9 and the surge tank 11 to provide communication between an upstream portion and a downstream portion of the intake passage 3 with respect to the throttle valve 10. FIG. 2 is a schematic view showing configurations of the intake passage 3, the bypass passage 21, and others. An ejector 22 is placed in the bypass passage 21. This ejector 22 is configured to generate a negative pressure by the air flowing from the intake passage 3 into the bypass passage 21.

The evaporated fuel treatment apparatus in this embodiment is arranged to collect and treat evaporated fuel (vapor) generated in the fuel tank 5 without releasing the evaporated fuel into atmosphere. This apparatus is provided with a canister 23 for collecting or trapping the vapor generated in the fuel tank 5. The canister 23 contains an adsorbent made of activated carbon to adsorb the vapor.

The canister 23 is connected to an atmosphere passage 24 for introducing atmospheric air into the canister 23. A distal end of the atmosphere passage 24 is communicated with an entrance of an oil feed pipe 5*a* provided in the fuel tank 5. The atmosphere passage 24 is provided with a filter 25. A distal end of a purge passage 26 extending from the canister 23 is connected to the ejector 22. In some midpoint of the purge passage 26, a purge vacuum switching valve (purge VSV) 27 serving as an electric drive valve is placed in order to open and close the purge passage 26. The purge VSV 27 is opened during operation of the engine 1 to open the purge passage 26. One end of a vapor passage 28 extending from the canister 23 is communicated with the fuel tank 5.

This evaporated fuel treatment apparatus is arranged such that the canister 23 collects vapor generated in the fuel tank 5 once through the purge passage 28. While the purge VSV 27 is in a valve opening state during the operation of the engine 1, air flowing in the intake passage 3 is also allowed to flow in the bypass passage 21, thus generating a negative pressure in the ejector 22. By this generated negative pressure, the vapor collected in the canister 23 is drawn from the canister 23 to the ejector 22 via the purge passage 26 and then purged into the intake passage 3 via the bypass passage 21.

In this embodiment, in the vapor passage 28, a block valve 29 is placed to control the flow of gas between the fuel tank 5 and the canister 23. This block valve 29 is configured to open when the internal pressure of the fuel tank 5 becomes a positive pressure equal to or larger than a predetermined value and close by the negative pressure generated when the vapor collected in the canister 23 is purged into the intake passage 3.

Figure 3:
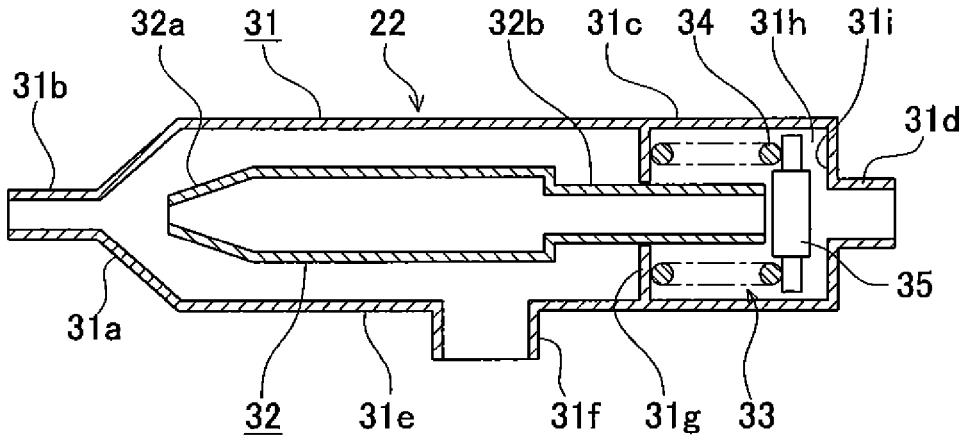
FIG. 3 is a sectional view showing a schematic configuration of an ejector in the first embodiment.

FIG. 3 is a sectional view showing a schematic configuration of the ejector 22. The ejector 22 has a double-pipe structure including an outer pipe 31 and an inner pipe 32 placed inside the outer pipe 31. A front end portion 31*a* of the outer pipe 31 has a funnel-like shape and includes an outlet pipe joint 31*b* connected to a downstream portion of the bypass passage 21. A rear end portion 31*c* of the outer pipe 31 is formed with an inlet pipe joint 31*d* connected to an upstream portion of the bypass passage 21. An intermediate portion 31*e* of the outer pipe 31 is formed with a purge pipe joint 31*f* connected to the distal end of the purge passage 26. A front end portion of the inner pipe 32 is formed as a funnel-shaped nozzle 32*a* and is directed to the front end portion 31*a* of the outer pipe 31, that is, the downstream portion of the bypass passage 21. A rear end portion 32*b* of the inner pipe 32 is communicated with the upstream portion of the bypass passage 21 through the inlet pipe joint 31*d* of the outer pipe 31. The ejector 22 introduces the air flowing in the bypass passage 21 into the inner pipe 32 as drive gas, and ejects the air in the form of a low-pressure supersonic flow from the nozzle 32*a* to generate a negative pressure between the nozzle 32*a* and the front end portion 31*a* of the outer pipe 31. This negative pressure acts on the purge passage 26 through the purge pipe joint 31*f*.

In this embodiment, a pressure-sensitive open/close valve 33 is placed on the upstream side of the ejector 22. Specifically, the rear end portion 31*c* of the outer pipe 31 is provided with a valve chamber 31*h* partitioned by a partition wall 31*g*. In the valve chamber 31*h*, the open/close valve 33 is provided in correspondence with the rear end portion 32*b* of the inner pipe 32. The open/close valve 33 includes a spring 34 and a valve element 35. The valve element 35 is placed between a rear end of the inner pipe 32 and a rear-end inner wall 31*i* of the outer pipe 31 so as to open and close a rear-end opening of the inner pipe 32. When the valve element 35 closes the rear-end opening of the inner pipe 32, the bypass passage 21 is closed. The spring 34 is interposed between the partition wall 31*g* and the valve element 35 and urges the valve element 35 in a direction (rightward in FIG. 3) to open the bypass passage 21. The open/close valve 33 is subjected to the pressure in the upstream portion of the bypass passage 21, i.e., the pressure (atmospheric pressure) in the intake passage 3 upstream of the throttle valve 10, and the pressure in the downstream portion of the bypass passage 21, i.e., the pressure (intake pressure) in the intake passage 3 downstream of the throttle valve 10, respectively. The open/close valve 33 is operated according to a pressure difference between the atmospheric pressure and the intake pressure. When the pressure difference exceeds a predetermined value during operation of the engine 1, the bypass passage 21 is closed. In other words, when the pressure difference exceeds the predetermined value, the valve element 35 is displaced against the urging force of the spring 34 by the negative pressure which is intake pressure, thereby closing the bypass passage 21. On the other hand, when the pressure difference is lower than the predetermined value during operation of the engine 1, the valve element 35 is displaced by the urging force of the spring 34, thereby opening the bypass passage 21.

According to the above configuration, during idle operation of the engine 1 with the throttle valve 10 almost closed, the open/close valve 33 blocks air from flowing from the intake passage 3 to the bypass passage 21 in order not to generate a negative pressure in the ejector 22. On the other hand, during normal operation of the engine 1 with the throttle valve 10 opened, i.e., during steady operation or accelerated operation, the open/close valve 33 allows air to flow from the intake passage 3 to the bypass passage 21 in order to generate a negative pressure in the ejector 22. In this embodiment, the open/close valve 33 corresponds to one example of an air-flow adjusting device of the invention.

Figure 4:
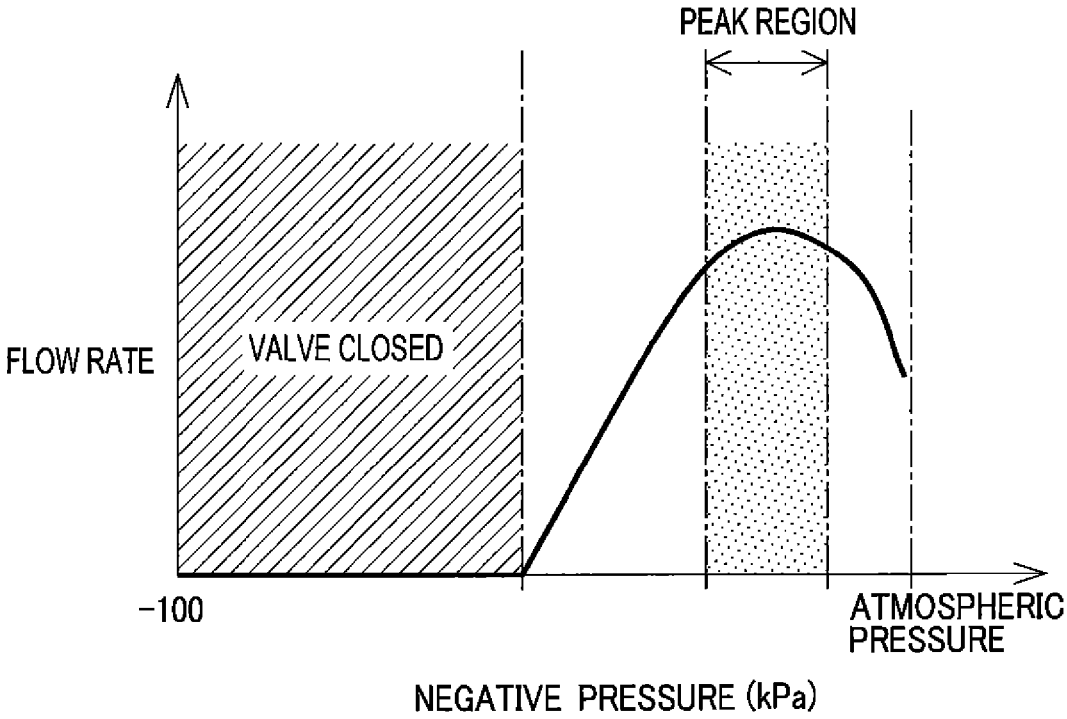
FIG. 4 is a graph showing a relationship between intake pressure (negative pressure) in the intake passage and an air flow rate in the bypass passage in the first embodiment.

FIG. 4 is a graph showing a relationship between the intake pressure (negative pressure) in the intake passage 3 and a flow rate of air in the bypass passage 21. This relationship reflects the opening and closing characteristics of the open/close valve 33. It is found from this graph that when the intake pressure is low (the negative pressure is large), the open/close valve 33 closes the bypass passage 21 to block air from flowing in the bypass passage 21. It is also found that when the intake pressure exceeds the predetermined value (the negative pressure is smaller than the predetermined value), the flow rate of air in the bypass passage 21 increases and decreases so as to include one maximum value. A peak region shown in FIG. 4 is a region where air is needed to flow in the bypass passage 21 in order to make the ejector 22 to generate a maximum negative pressure.

According to the evaporated fuel treatment apparatus in this embodiment explained above, when the air flows from the intake passage 3 to the bypass passage 21 during operation of the engine 1, the negative pressure is generated in the ejector 22. By this generated negative pressure, the vapor collected in the canister 23 is drawn from the canister 23 to the ejector 22 through the purge passage 26 and then purged into the intake passage 3 through the bypass passage 21.

Herein, the flow of air in the bypass passage 21 is adjusted by the open/close valve 33 placed in the ejector 22. For instance, during idle operation or the like with the throttle valve 10 almost closed, the open/close valve 33 closes the bypass passage 21 by a pressure difference between the intake pressure and the atmospheric pressure in order not to generate a negative pressure in the ejector 22. Thus, air is blocked from flowing from the intake passage 3 to the bypass passage 21. Accordingly, during the idle operation or the like, air does not flow in the bypass passage 21, so that the ejector 22 does not function. Thus, no vapor is purged from the canister 23 by the ejector 22. Since no air flows in the bypass 21, no air is supplied to the engine 1 through the bypass passage 21 and hence the idle operation or the like is not affected by the air. In other words, the idle rotation speed of the engine 1 will not rise unstably. Even if no air flows in the bypass 21, however, the intake pressure (negative pressure) in the intake passage 3 acts on the ejector 22 through the exit side of the bypass passage 21. Consequently, the intake pressure (negative pressure) acts on the purge passage 26 through the downstream portion of the bypass passage 21 and the ejector 22, causing the vapor collected in the canister 23 to flow to the ejector 22 through the purge passage 26, further purging the vapor from the bypass passage 21 to the intake passage 3.

On the other hand, for example, during normal operation where the throttle valve 10 is open, that is, during steady operation or accelerated operation and others, the open/close valve 33 opens the bypass passage 21 by the above pressure difference to generate a negative pressure in the ejector 22. This allows air to flow from the intake passage 3 to the bypass passage 21, thus generating the negative pressure in the ejector 22. Therefore, the vapor collected in the canister 23 is drawn by the generated negative pressure and actively purged to the intake passage 3 through the purge passage 26, the ejector 22, and the bypass passage 21.

As explained above, this embodiment can purge the vapor collected in the canister 23 to the intake passage 3 irrespective of the operating state of the engine 1, that is, irrespective of the magnitude of the aforementioned pressure difference. In addition, the second path as in the conventional art does not have to be provided to selectively use the ejector 22 and hence the ejector 22 can have a simple configuration.

This embodiment uses the pressure-sensitive open/close valve 33 to adjust the flow of air in the bypass passage 21. Therefore, no electric structure is needed to control the open/close valve 33. In this regard, the configuration for selectively using the ejector 22 can be made simpler. Further, the configuration of the open/close valve 33 can be made more simple by the spring 34 and the valve element 35. This makes it possible to reduce the size of the open/close valve 33 and contribute to downsizing of the configuration for selectively using the ejector 22.

Second Embodiment

A second embodiment of an evaporated fuel treatment apparatus for an internal combustion engine according to the present invention will be described in detail below referring to the accompanying drawings.

In the following explanations, similar or identical configurations to those in the first embodiment are given the same reference signs and their details are omitted. The following explanations are made with a focus on differences from the first embodiment.

Figure 5:
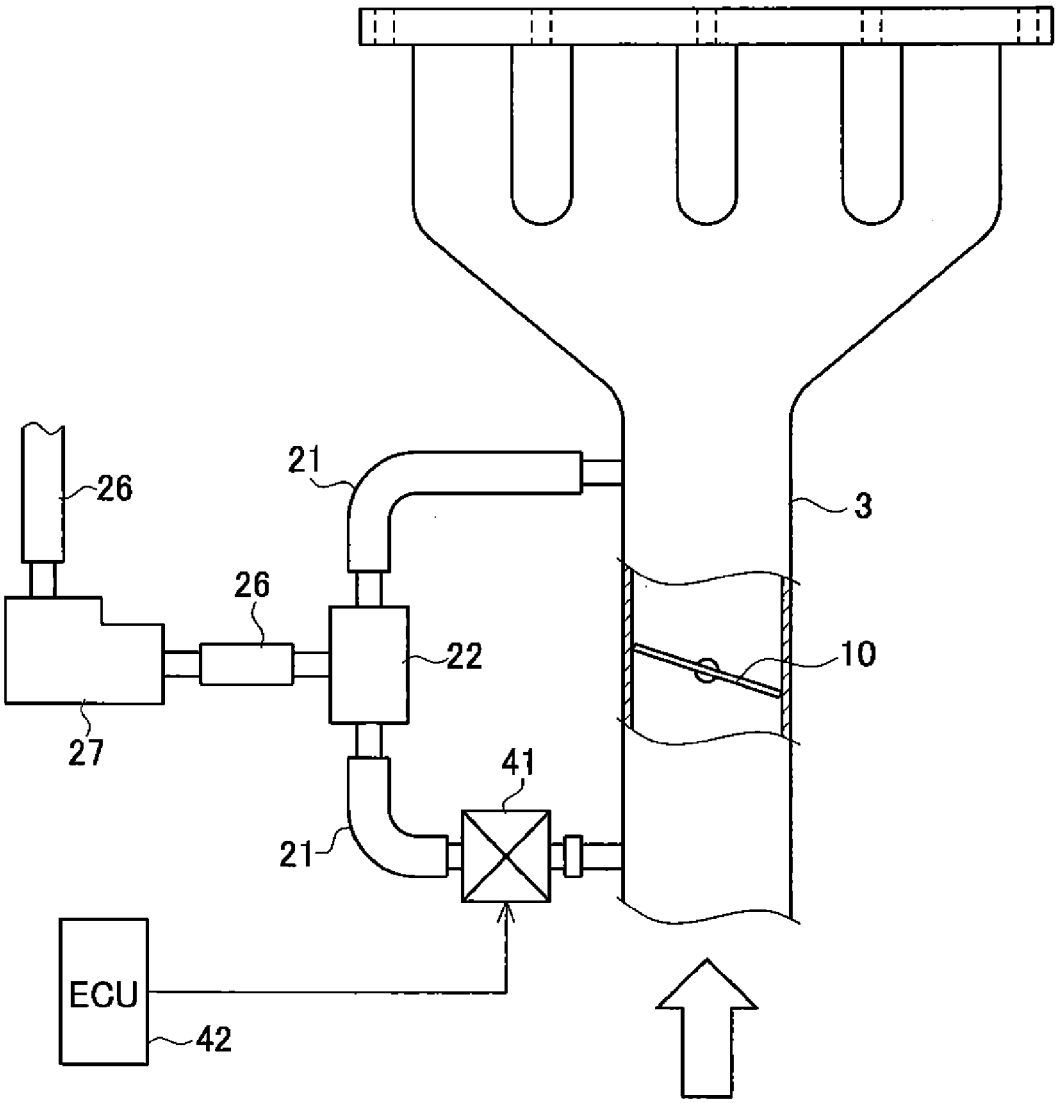
FIG. 5 is a schematic diagram showing configurations of an intake passage, a bypass passage, and others in a second embodiment.

FIG. 5 is a schematic diagram showing the configurations of an intake passage 3, a bypass passage 21, and others in the evaporated fuel treatment apparatus in this embodiment, corresponding to FIG. 2. This embodiment differs from the first embodiment in an air-flow adjusting device in the bypass passage 21. Specifically, the air-flow adjusting device in this embodiment includes a bypass VSV 41 placed upstream of the ejector 22 to serve as an electric drive valve for opening and closing the bypass passage 21 and an electronic control unit (ECU) 42 serving as a control device for controlling the bypass VSV 41. The bypass VSV 41 is placed in the bypass passage 21 upstream of the ejector 22. The ejector 22 is not provided with the open/close valve 33 of the first embodiment.

In this embodiment, the ECU 42 controls the bypass VSV 41 to open and close the bypass passage 21 according to a pressure difference between the pressure in an upstream portion and the pressure in a downstream portion of the bypass passage 21. The ECU 42 in this embodiment also controls the bypass VSV 41 by determining the operating state that reflects the pressure difference based on various signals representing the operating state of the engine 1 (e.g., engine rotation speed, intake pressure, throttle opening degree, engine cooling water temperature, etc.). At idle operation of the engine 1, for example, the ECU 42 determines that the pressure difference is a predetermined value or higher and thus controls to close the bypass VSV 41 in order to close the bypass passage 21. On the other hand, at normal operation of the engine 1, i.e., at steady operation or accelerated operation, for example, the ECU 42 determines that the pressure difference is lower than the predetermined value and thus controls to open the bypass VSV 41 in order to open the bypass passage 21.

According to this embodiment, consequently, during the idle operation of the engine 1, for example, the bypass VSV 41 is controlled to be closed by the ECU 42 to close the bypass passage 21, so that no air is allowed to flow in the bypass passage 21 and thus the ejector 22 does not function. Accordingly, no air is supplied to the engine 1 through the bypass passage 21 and hence the idle operation of the engine 1 is not affected by the air. However, at that time, the intake pressure (negative pressure) in the intake passage 3 downstream of the throttle valve 10 acts on the ejector 22 and the purge passage 21 through the bypass passage 21. This negative pressure enables purging of the vapor collected in the canister 23 to the intake passage 3 through the purge passage 26, the ejector 22, and the bypass passage 21.

On the other hand, during the normal operation of the engine 1, i.e., during the steady operation or the accelerated operation, for example, the bypass VSV 41 is controlled to open by the ECU 42 to open the bypass passage 21, thereby allowing air to flow in the bypass passage 21 and thus generating a negative pressure in the ejector 22. By this generated negative pressure, the vapor collected in the canister 23 is actively purged to the intake passage 3 through the purge passage 26, the ejector 22, and the bypass passage 21.

As above, this embodiment can purge the vapor collected in the canister 23 to the intake passage 3 irrespective of the operating state of the engine 1, that is, irrespective of the magnitude of the aforementioned pressure difference. In addition, this embodiment does not have to include the second path as in the conventional art to selectively use the ejector 22 and hence can provide the ejector 22 in a simple configuration.

In this embodiment, furthermore, the bypass VSV 41 is controlled by the ECU 42, so that the flow of air in the bypass passage 21 can be accurately adjusted according to an optional condition related to the operating state of the engine 1. In this regard, it is possible to efficiently purge vapor to the intake passage 3 in conformity with characteristics of an engine in an HV vehicle and a CVT-equipped vehicle.

Third Embodiment

A third embodiment of an evaporated fuel treatment apparatus for an internal combustion engine according to the present invention will be described in detail below referring to the accompanying drawings.

Figure 6:
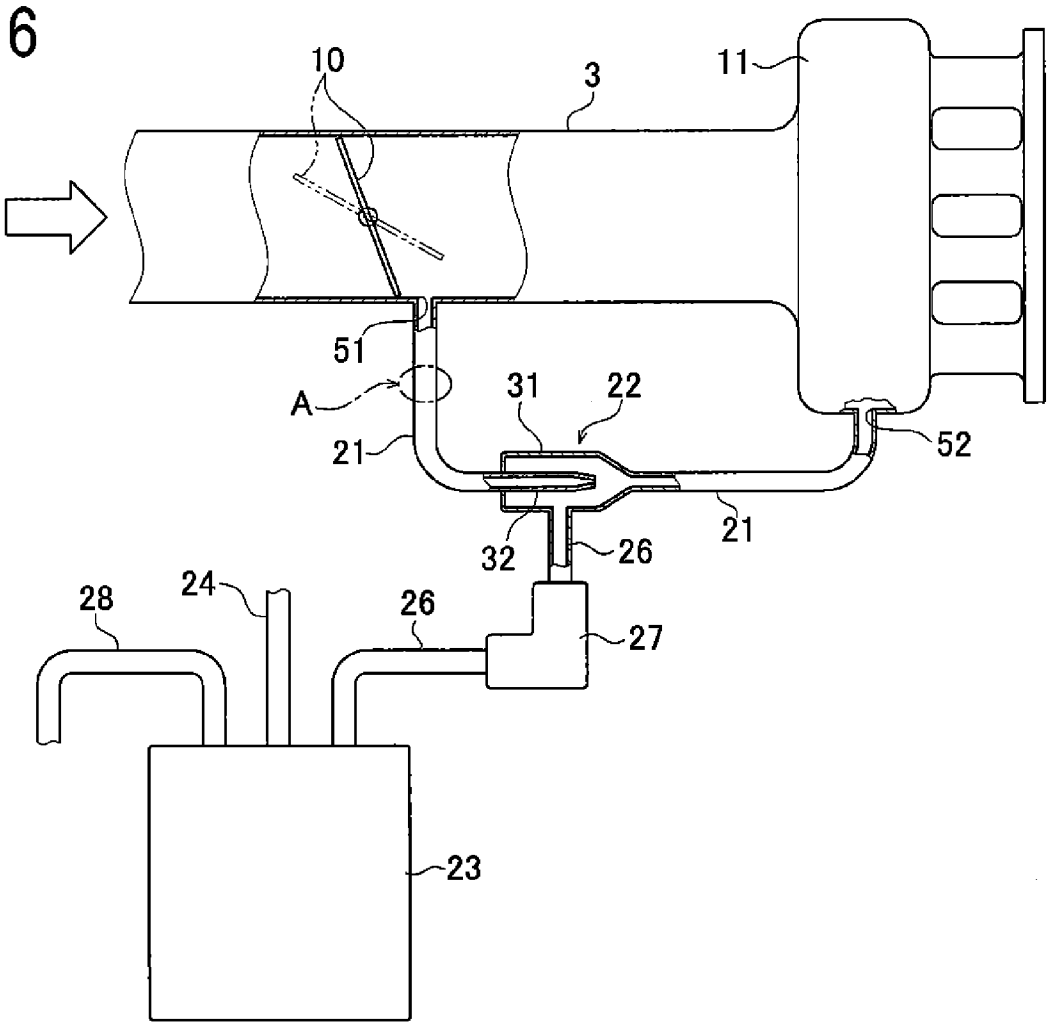
FIG. 6 is a schematic diagram showing configurations of an intake passage, a bypass passage, and others in a third embodiment.

FIG. 6 is a schematic diagram showing the configurations of an intake passage 3, a bypass passage 21, and others in the evaporated fuel treatment apparatus in this embodiment, corresponding to FIG. 2. This embodiment differs from the first embodiment in an air-flow adjusting device in the bypass passage 21. Specifically, the air-flow adjusting device in this embodiment includes the intake passage 3, a throttle valve 10, and the bypass 21. Herein, differing from the above embodiments, the bypass passage 21 is provided for the intake passage 3 downstream of the throttle valve 10. An entrance 51 of the bypass passage 21 is formed to open into the intake passage 3 in the vicinity of the throttle valve 10. An exit 52 of the bypass passage 21 is formed to open into a surge tank 11 of the intake passage 3 downstream of the entrance 51. An ejector 22 does not include the open/close valve 33 of the first embodiment.

Figure 7:
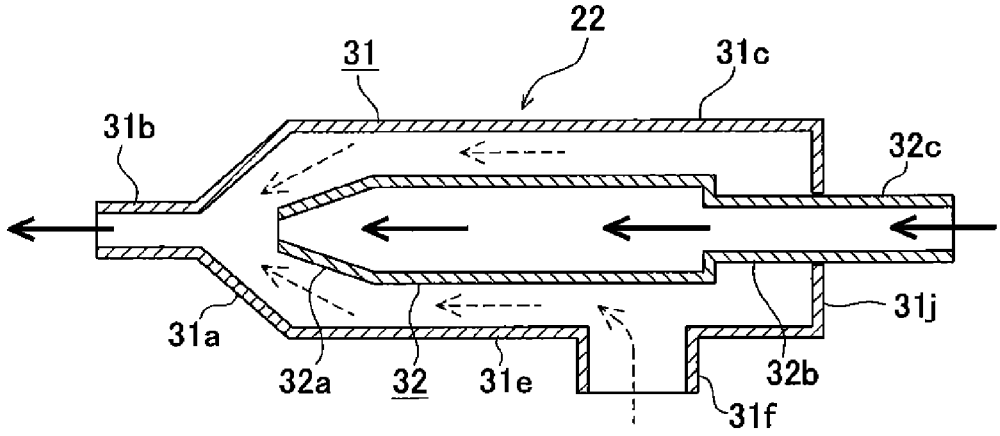
FIG. 7 is a sectional view showing a schematic configuration of an ejector in the third embodiment.

FIG. 7 is a sectional view showing a schematic configuration of the ejector 22. This ejector 22 is arranged such that a rear end portion 32*b* of an inner pipe 32 penetrates through and protrudes out of a bottom wall 31*j* of a rear end portion 31*c* of an outer pipe 31, forming an inlet pipe joint 32*c*. Other configurations are basically identical to those of the ejector 22 shown in FIG. 3.

Figure 8:
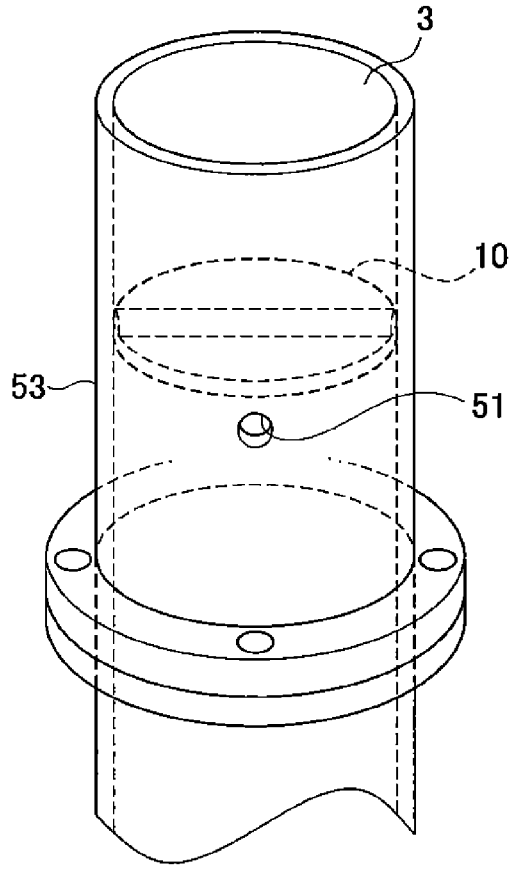
FIG. 8 is a perspective view showing a relationship between an entrance of the bypass passage and a throttle valve in the third embodiment.

FIG. 8 is a perspective view showing a relationship between the entrance 51 of the bypass passage 21 and the throttle valve 10. In this embodiment, as shown in FIG. 8, the entrance 51 is a circular hole formed in an intake pipe 53 defining the intake passage 3 and located immediately downstream of the throttle valve 10.

Figure 9:
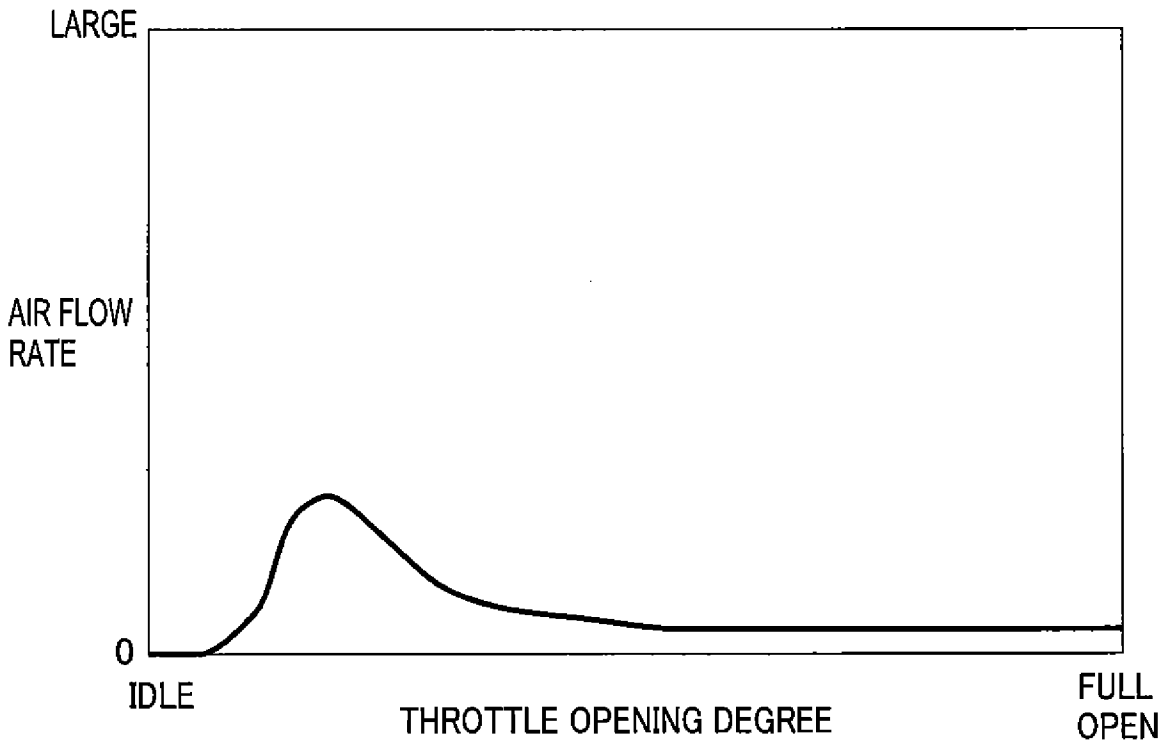
FIG. 9 is a conceptual graph showing a relationship (flow-rate characteristics) of an air flow rate in the bypass passage upstream of the ejector with respect to a throttle opening degree in the third embodiment.

FIG. 9 is a graph showing a conceptual relationship (flow-rate characteristics) of an air flow rate in a region (encircled by a chain line ellipse A in FIG. 6) of the bypass passage 21 upstream of the ejector 22 with respect to an opening degree of the throttle valve 10 (a throttle opening degree). As seen from this graph, no air flows in the bypass passage 21 in a range where the throttle opening degree is approximate to "0%". When the throttle opening degree increases from the idle range, the air flow rate becomes a maximum at the opening degree of about "20%". Then, the air flow rate decreases as the throttle opening degree increases and then becomes almost constant at the opening degree in a range of "50%-100% (Full open)". In other ranges than the idle range, air is allowed to flow in the bypass passage 21, generating a negative pressure in the ejector 22. By that negative pressure, vapor is purged.

According to this embodiment, since the entrance 51 of the bypass passage 21 is provided to open into the intake passage 3 in the vicinity of the throttle valve 10, the pressure which will act on the entrance 51 can be changed by the opening degree of the throttle valve 10. When the throttle valve 10 is almost closed, for example, during idle operation of the engine 1, both the entrance 51 and the exit 52 of the bypass passage 21 are located downstream of the throttle valve 10. At that time, a pressure difference between the pressure in the upstream portion and the pressure in the downstream portion of the bypass passage 21 is small. Accordingly, no air flows from the intake passage 3 to the bypass passage 21 and thus the ejector 22 does not function. However, at that time, the intake pressure (negative pressure) in the intake passage 3 acts on the ejector 22 and the purge passage 26 through the entrance 51, the exit 52, and the bypass passage 21. This enables purging of the vapor collected in the canister 23 to the intake passage 3 through the purge passage 26, the ejector 22, and the bypass passage 21.

On the other hand, when the throttle valve 10 is opened, for example, during normal operation of the engine 1, i.e., during steady operation or accelerated operation, only the entrance 51 of the bypass passage 21 is located on an upstream side of the throttle valve 10 in an open state. At that time, the above pressure difference occurs, causing air to flow from the intake passage 3 to the bypass passage 21, thereby generating a negative pressure in the ejector 22. By this generated negative pressure, the vapor collected in the canister 23 is purged actively to the intake passage 3 through the purge passage 26, the ejector 22, and the bypass passage 21.

As above, this embodiment can purge the vapor collected in the canister 23 to the intake passage 3 irrespective of the operating state of the engine 1, that is, irrespective of the magnitude of the pressure difference. In addition, this embodiment does not have to include the second path as in the conventional art to selectively use the ejector 22 and hence can provide the ejector 22 in a simple configuration.

In this embodiment, furthermore, no additional component other than the ejector 22 is needed to adjust the flow of air in the bypass passage 21. In this regard, the configuration for selectively using the ejector 22 can be made simpler, contributing to downsizing of the structure.

The present invention is not limited to the above embodiments and may be embodied in other specific forms without departing from the essential characteristics thereof.

Figure 10:
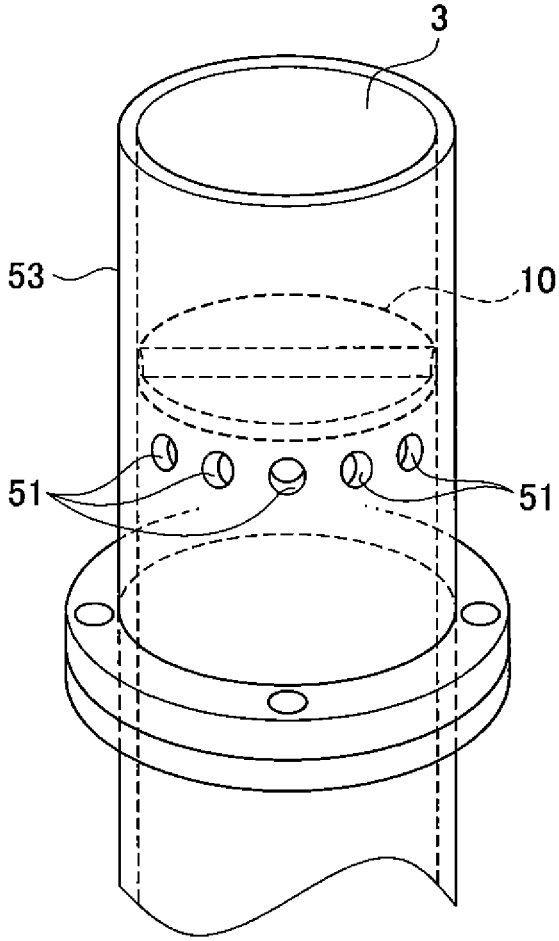
FIG. 10 is a perspective view showing a relationship between an entrance of a bypass passage and a throttle valve in another embodiment.
Figure 11:
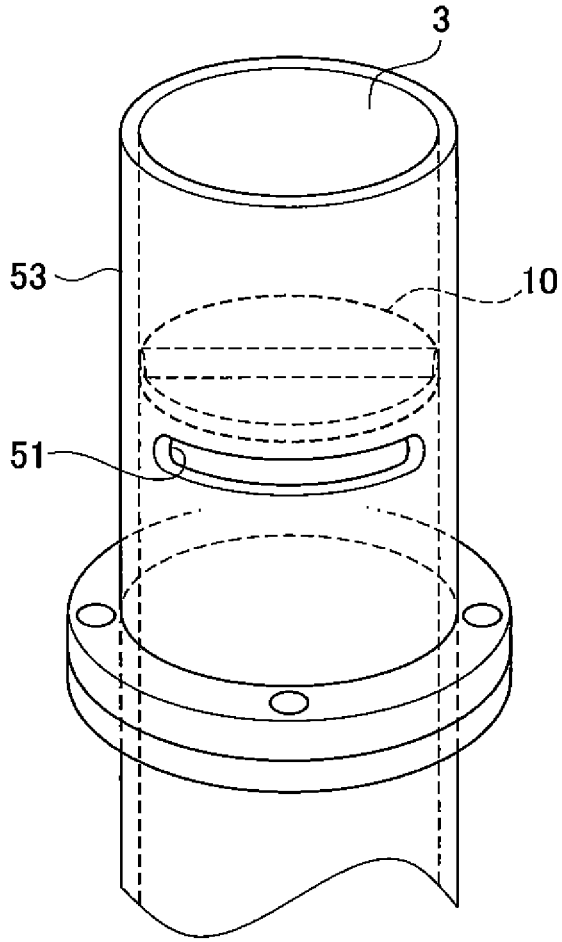
FIG. 11 is a perspective view showing a relationship between an entrance of a bypass passage and a throttle valve in another embodiment.

For instance, in the third embodiment, as shown in FIG. 8, the entrance 51 of the bypass passage 21 is formed in the form of a single circular hole in the intake pipe 53 immediately downstream of the throttle valve 10. On the other hand, as shown in FIG. 10, the entrance 51 of the bypass passage 21 may be provided in the form of a plurality of circular holes arranged circumferentially in the outer periphery of the intake pipe 53 immediately downstream of the throttle valve 10. In this case, the number of circular holes may be adapted to the size and the type of the engine. As shown in FIG. 11, the entrance 51 of the bypass passage 21 may be formed in the form of a long hole (a slit) formed circumferentially in the outer periphery of the intake pipe 53 immediately downstream of the throttle valve 10. In this case, similarly, the length and the width of the long hole may be adapted to the size and the type of the engine.

While the presently preferred embodiment of the present invention has been shown and described, it is to be understood that this disclosure is for the purpose of illustration and that various changes and modifications may be made without departing from the scope of the invention as set forth in the appended claims.

INDUSTRIAL APPLICABILITY

The present invention can be applied to for example an engine in an HV vehicle and a CVT-equipped vehicle.

REFERENCE SIGNS LIST

1 Engine (Internal combustion engine)
3 Intake passage
5 Fuel tank
10 Throttle valve
21 Bypass passage
22 Ejector
23 Canister
26 Purge passage
33 Open/close valve (Air-flow adjusting device)
34 Spring
35 Valve element
41 Bypass VSV (Electric drive valve)
42 ECU (Control unit)
51 Entrance
52 Exit

The invention claimed is:

1. An evaporated fuel treatment apparatus provided in an internal combustion engine including a throttle valve in an intake passage, the evaporated fuel treatment apparatus being arranged to treat evaporated fuel generated in a fuel tank by collecting the evaporated fuel in a canister and purging the collected evaporated fuel to the intake passage through a purge passage, wherein the evaporated fuel treatment apparatus comprises:

a bypass passage provided for the intake passage, the bypass passage being placed to communicate an upstream portion and a downstream portion of the intake passage with respect to the throttle valve in the intake passage;

an ejector placed in the bypass passage and arranged to generate a negative pressure by air flowing from the intake passage to the bypass passage, the purge passage being connected to the ejector so that the negative pressure generated in the ejector draws the collected evaporated fuel from the canister to the ejector through the purge passage, the evaporated fuel being to be purged to the intake passage through the bypass passage; and an air-flow adjusting device for allowing or blocking flow of air from the intake passage into the bypass passage according to a pressure difference between pressure in an upstream portion and pressure in a downstream portion of the bypass passage during operation of the internal combustion engine, the air-flow adjusting device includes a pressure-sensitive open/close valve placed upstream of the ejector and arranged to open and close the bypass passage, the ejector has a double-pipe structure including an outer pipe and an inner pipe placed inside the outer pipe, the outer pipe includes a front end portion having a funnel-like shape, an intermediate portion, and a rear end portion, the front end portion including an outlet pipe joint connected to the downstream portion of the bypass passage, the rear end portion including an inlet pipe joint connected to the upstream portion of the bypass passage and the intermediate portion including a purge pipe joint connected to the purge passage, the inner pipe includes a front end portion and a rear end portion, the front end portion including a funnel-like nozzle and being directed toward the front end portion of the outer pipe, and the rear end portion being communicated with the bypass passage through the inlet pipe joint of the outer pipe, the ejector is configured to introduce the air flowing in the bypass passage into the inner pipe as drive gas, eject the air in the form of a low-pressure supersonic flow from the nozzle of the inner pipe to generate a negative pressure between the nozzle and the front end portion of the outer pipe, and the open/close valve includes a spring and a valve element, the valve element being placed to open and close an opening of the rear end portion of the inner pipe between the rear end portion of the inner pipe and an inner wall of the rear end portion of the outer pipe.

2. The evaporated fuel treatment apparatus for internal combustion engine according to claim 1, wherein the open/close valve is subjected to pressure in the upstream portion of the intake passage with respect to the throttle valve through the upstream portion of the bypass passage and pressure in the downstream portion of the intake passage with respect to the throttle valve through the downstream portion of the bypass passage, the open/close valve is arranged to operate according to a pressure difference between the upstream pressure and the downstream pressure in the intake passage, the bypass passage is closed when the pressure difference exceeds a predetermined value, and the bypass passage is opened when the pressure difference is equal to or lower than the predetermined value.

3. The evaporated fuel treatment apparatus for internal combustion engine according to claim 2, wherein the spring of the open/close valve urges the valve element in a direction to open the bypass passage, the valve element being movable to be displaced by the downstream pressure in the intake passage against an urging force of the spring to close the bypass passage when the pressure difference exceeds the predetermined value and to be displaced by the urging force of the spring to open the bypass passage.

4. An evaporated fuel treatment apparatus provided in an internal combustion engine including a throttle valve in an intake passage, the evaporated fuel treatment apparatus being arranged to treat evaporated fuel generated in a fuel tank by collecting the evaporated fuel in a canister and purging the collected evaporated fuel to the intake passage through a purge passage, wherein the evaporated fuel treatment apparatus comprises:

a bypass passage provided for the intake passage, an ejector placed in the bypass passage and arranged to generate a negative pressure by air flowing from the intake passage to the bypass passage, the purge passage being connected to the ejector so that the negative pressure generated in the ejector draws the collected evaporated fuel from the canister to the ejector through the purge passage, the evaporated fuel being to be purged to the intake passage through the bypass passage; and an air-flow adjusting device for allowing or blocking flow of air from the intake passage into the bypass passage according to a pressure difference between pressure in an upstream portion and pressure in a downstream portion of the bypass passage during operation of the internal combustion engine, the air-flow adjusting device includes the intake passage, the throttle valve, and the bypass passage;

the bypass passage is provided for a portion of the intake passage downstream of the throttle valve and includes an entrance and an exit, the entrance of the bypass passage is provided to open into the intake passage in the vicinity of the throttle valve, the exit of the bypass passage is provided to open into the intake passage downstream of the entrance, when the throttle valve is almost closed, the entrance of the bypass passage is located downstream of the throttle valve so that the pressure difference does not occur and air is blocked from flowing from the intake passage to the bypass passage, and when the throttle valve is opened, the entrance of the bypass passage is located upstream of the throttle valve so that the pressure difference occurs and air is allowed to flow from the intake passage to the bypass passage.

5. The evaporated fuel treatment apparatus for internal combustion engine according to claim 4, wherein the ejector has a double-pipe structure including an outer pipe and an inner pipe placed inside the outer pipe, the outer pipe includes a front end portion having a funnel-like shape, an intermediate portion, and a rear end portion, the front end portion including an outlet pipe joint connected to the downstream portion of the bypass passage, the rear end portion including an inlet pipe joint connected to the upstream portion of the bypass passage, and the intermediate portion including a purge pipe joint connected to the purge passage, the inner pipe includes a front end portion and a rear end portion, the front end portion including a funnel-like nozzle and being directed toward the front end portion of the outer pipe, the rear end portion penetrates through and protrudes out of the bottom wall of the rear end portion of the outer pipe to form an inlet pipe joint, the ejector is configured to introduce the air flowing in the bypass passage into the inner pipe as drive gas, eject the air in the form of a low-pressure supersonic flow from the nozzle of the inner pipe to generate a negative pressure between the nozzle and the front end portion of the outer pipe.

6. The evaporated fuel treatment apparatus for internal combustion engine according to claim 4, wherein the entrance of the bypass passage is constituted of at least one circular hole and formed in an intake pipe defining the intake passage immediately downstream of the throttle valve.

7. The evaporated fuel treatment apparatus for internal combustion engine according to claim 4, wherein the entrance of the bypass passage is a long hole formed circumferentially in the outer periphery of the intake pipe defining the intake passage immediately downstream of the throttle valve.

* * * * *